US011752652B2

(12) United States Patent
Niimi et al.

(10) Patent No.: US 11,752,652 B2
(45) Date of Patent: Sep. 12, 2023

(54) CUTTING APPARATUS, APPARATUS FOR MANUFACTURING SHEET MATERIAL, AND APPARATUS FOR MANUFACTURING GYPSUM BUILDING MATERIAL

(71) Applicant: YOSHINO GYPSUM CO., LTD., Tokyo (JP)

(72) Inventors: Katsumi Niimi, Tokyo (JP); Masaaki Takahashi, Tokyo (JP); Tsuyoshi Yoshida, Tokyo (JP); Masaki Ushizawa, Tokyo (JP)

(73) Assignee: YOSHINO GYPSUM CO., LTD., Tokyo (JP)

( * ) Notice: Subject to any disclaimer, the term of this patent is extended or adjusted under 35 U.S.C. 154(b) by 331 days.

(21) Appl. No.: 16/330,551

(22) PCT Filed: Aug. 18, 2017

(86) PCT No.: PCT/JP2017/029653
§ 371 (c)(1),
(2) Date: Mar. 5, 2019

(87) PCT Pub. No.: WO2018/051722
PCT Pub. Date: Mar. 22, 2018

(65) Prior Publication Data

US 2020/0368931 A1 Nov. 26, 2020

(30) Foreign Application Priority Data

Sep. 14, 2016 (JP) ..... 2016-179922

(51) Int. Cl.
*B26D 1/40* (2006.01)
*B26D 7/18* (2006.01)
*B28B 11/14* (2006.01)

(52) U.S. Cl.
CPC ..... *B26D 1/40* (2013.01); *B26D 7/1854* (2013.01); *B28B 11/14* (2013.01)

(58) Field of Classification Search
CPC ..... B26D 1/40; B26D 7/1854; B23D 59/006; Y10T 83/2066; Y10T 83/2068;
(Continued)

(56) References Cited

U.S. PATENT DOCUMENTS 1,205,282 A * 11/1916 Spiess ..... B65H 29/041 83/345
3,322,037 A * 5/1967 Cavagnero ..... B23Q 11/006 409/137

(Continued)

FOREIGN PATENT DOCUMENTS

DE 4313452 10/1994
JP S57-027713 2/1982

(Continued)

OTHER PUBLICATIONS

International Search Report for PCT/JP2017/029653 dated Nov. 14, 2017.

(Continued)

*Primary Examiner* — Jennifer S Matthews
(74) *Attorney, Agent, or Firm* — IPUSA, PLLC

(57) ABSTRACT

A cutting apparatus is provided. The cutting apparatus includes a cutter disposed in a conveying path for conveying a plate-shaped object and configured to cut the object, a downstream conveyor disposed downstream of the cutter in the conveying path and configured to convey the object, and a foreign-matter adhesion preventer disposed between the cutter and the downstream conveyor and configured to prevent foreign matter scattered by the cutter from adhering to the downstream conveyor.

10 Claims, 3 Drawing Sheets

(58) Field of Classification Search
CPC . Y10T 83/207; Y10T 83/2072; Y10T 83/242; Y10T 83/364; Y10T 83/6582
See application file for complete search history.

(56) References Cited

U.S. PATENT DOCUMENTS

| | | | | |
|---|---|---|---|---|
| 4,715,078 | A | 12/1987 | Howard et al. | |
| 5,259,282 | A | 11/1993 | Cothrell | |
| 7,096,529 | B2 * | 8/2006 | Cunnington | B08B 6/00 15/1.51 |
| 2004/0074366 | A1 | 4/2004 | Choo et al. | |
| 2006/0191426 | A1 * | 8/2006 | Timmerman | B31B 50/88 101/24 |
| 2009/0165238 | A1 * | 7/2009 | Bennett | B08B 5/026 15/309.1 |
| 2014/0137517 | A1 * | 5/2014 | Hammacher | B65B 35/50 53/443 |
| 2014/0318340 | A1 * | 10/2014 | Mochizuki | B65H 7/20 83/346 |
| 2015/0136564 | A1 * | 5/2015 | Hurni | B65B 35/50 198/418 |
| 2018/0113397 | A1 * | 4/2018 | Ozeki | G03G 15/50 |

FOREIGN PATENT DOCUMENTS

| | | | | |
|---|---|---|---|---|
| JP | S60-088709 | U | 6/1985 | |
| JP | S61-132700 | | 6/1986 | |
| JP | S61-136798 | | 6/1986 | |
| JP | H01-297187 | | 11/1989 | |
| JP | 2004-145337 | | 5/2004 | |
| JP | 2005-262409 | | 9/2005 | |
| JP | 2008-302463 | | 12/2008 | |
| JP | 2010-240820 | | 10/2010 | |
| JP | 2015-000526 | | 1/2015 | |
| KR | 20080077333 | A * | 8/2008 | |
| WO | 1984/002067 | | 6/1984 | |
| WO | WO-2005080244 | A1 * | 9/2005 | B23D 35/008 |

OTHER PUBLICATIONS

Office Action dated Dec. 10, 2020 (Indian Patent Application No. 201917009011).
Extended European Search Report for 17850628.3 dated Jun. 27, 2019.

* cited by examiner

CUTTING APPARATUS, APPARATUS FOR MANUFACTURING SHEET MATERIAL, AND APPARATUS FOR MANUFACTURING GYPSUM BUILDING MATERIAL

TECHNICAL FIELD

The present application relates to a cutting apparatus, an apparatus for manufacturing a sheet material, and an apparatus for manufacturing a gypsum building material.

BACKGROUND ART

Ceramics products and resin products having plate shapes (or sheet shapes) have been manufactured and used for various purposes.

Although methods for manufacturing plate-shaped products vary depending on the products to be manufactured, a plate-shaped product is manufactured, for example, by kneading and shaping materials to form an intermediate product having a plate shape and by cutting, drying, and calcining the intermediate product as necessary while conveying the intermediate product with a conveyor.

In the process where the intermediate product or the product (which may be hereafter referred to as an "intermediate/end product") is conveyed, foreign matter such as swarf may adhere to the surface of the intermediate/end product. Depending on the amount of foreign matter, the intermediate/end product may need to be ejected as an unacceptable product. For this reason, various methods for reducing the amount of foreign matter and improving the yield have been considered.

For example, Patent Document 1 discloses a foreign matter removing method where air is discharged in a direction that is oblique to the conveying direction of a conveyor to blow away foreign matter.

RELATED-ART DOCUMENT

[Patent Document]

[Patent Document 1] Japanese Laid-Open Patent Publication No. H01-297187

DISCLOSURE OF INVENTION

Problems to be Solved by the Invention

However, although the foreign matter removing method disclosed in Patent Document 1 can remove foreign matter on a surface of a product not contacting the conveyor, i.e., an upper surface of the product, the foreign matter removing method cannot remove foreign matter on a surface of the product contacting the conveyor.

Also, in a cutting apparatus that is disposed in a conveying path of a plate-shaped intermediate product and configured to cut the intermediate product into pieces with a desired size to manufacture plate-shaped products, there is a case where foreign matter adheres to a surface of the intermediate product contacting a conveyor. Accordingly, there is a demand for a cutting apparatus that can prevent adhesion of foreign matter to a conveyor-contacting surface of an intermediate/end product that is cut by the cutting apparatus.

In view of the problems of the related-art technologies described above, one object of the present invention is to provide a cutting apparatus that can prevent adhesion of foreign matter to a conveyor-contacting surface of an object that is cut by the cutting apparatus.

Means for Solving the Problems

To solve the above-described problems, the present invention provides a cutting apparatus that includes a cutter disposed in a conveying path for conveying a plate-shaped object and configured to cut the object, a downstream conveyor disposed downstream of the cutter in the conveying path and configured to convey the object, and a foreign-matter adhesion preventer disposed between the cutter and the downstream conveyor and configured to prevent foreign matter scattered by the cutter from adhering to the downstream conveyor.

Advantageous Effect of the Invention

The present invention makes it possible to provide a cutting apparatus that can prevent adhesion of foreign matter to a conveyor-contacting surface of an object that is cut by the cutting apparatus.

DESCRIPTION OF EMBODIMENTS

Embodiments of the present invention are described below with reference to the accompanying drawings. However, the present invention is not limited to those embodiments, and variations and modifications may be made without departing from the scope of the present invention.

<Cutting Apparatus>

An example of a configuration of a cutting apparatus according to an embodiment is described below.

The cutting apparatus of the present embodiment may include the following components: a cutter that is disposed in a conveying path for conveying a plate-shaped object and configured to cut the object, a downstream conveyor that is disposed downstream of the cutter in the conveying path and configured to convey the object, and a foreign-matter adhesion preventer that is disposed between the cutter and the downstream conveyor and prevents foreign matter scattered by the cutter from adhering to the downstream conveyor.

The inventors of the present invention studied reasons that cause foreign matter to adhere to a conveyor-contacting surface of a plate-shaped intermediate/end product in a related-art cutting apparatus that is used in a process of manufacturing plate-shaped products to cut an intermediate product into pieces with a desired size. The study has revealed that swarf generated when a plate-shaped object is cut by a cutter of the cutting apparatus adheres to the surface of a downstream conveyor disposed downstream of the cutter in the conveying direction of the object. The study has also revealed that the swarf adhering to the surface of the downstream conveyor is transferred and adheres to the object being transferred, and that this is the cause of adhesion of foreign matter to the conveyor-contacting surface of the object.

The cutting apparatus of the present embodiment is obtained based on the above findings of the inventors of the present invention. Details of the configuration of the cutting apparatus of the present embodiment are described below.

Figure 1:
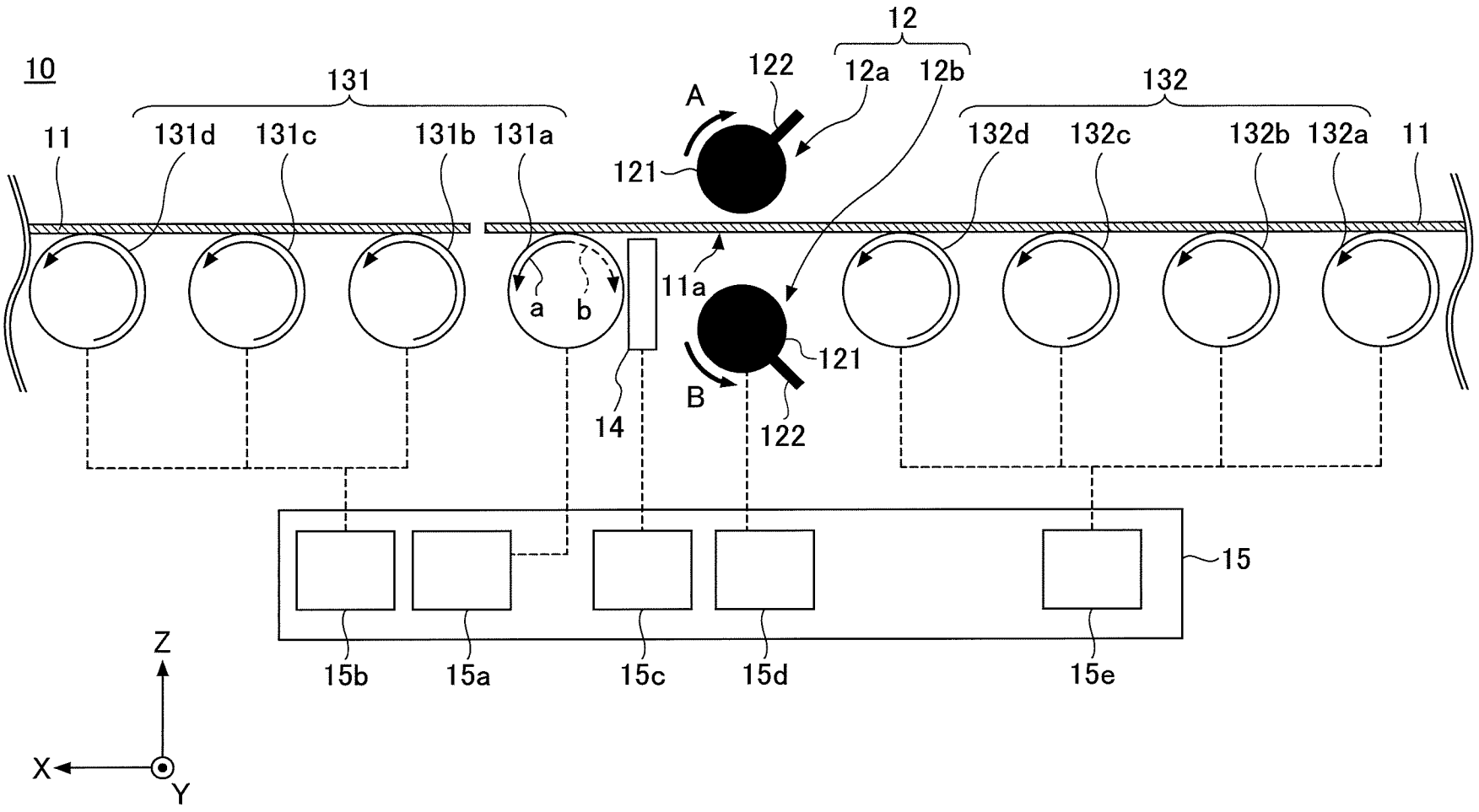
FIG. 1 is a schematic cross-sectional view of a cutting apparatus according to an embodiment of the present invention.

FIG. 1 illustrates an example of a configuration of the cutting apparatus of the present embodiment. In FIG. 1, the longitudinal direction of the page, i.e., a direction parallel to the conveying direction of an object described later, is referred to as an X-axis direction; a direction perpendicular to the conveying direction of the object (a direction perpendicular to the page surface) is referred to as a Y-axis direction; and the lateral direction of the page is referred to as a Z-axis direction.

FIG. 1 is a schematic cross-sectional view of a cutting apparatus 10 of the present embodiment taken along a plane that is parallel to the height direction (the Z-axis direction in FIG. 1) and the conveying direction (the X-axis direction in FIG. 1) of a plate-shaped object 11 to be cut by the cutting apparatus 10.

In the cutting apparatus 10 illustrated in FIG. 1, the plate-shaped object 11 is conveyed from right to left, i.e., in the X-axis direction in FIG. 1. A cutter 12 for cutting the plate-shaped object 11 is disposed in the conveying path of the plate-shaped object 11.

A downstream conveyor 131 is provided downstream of the cutter 12 in the conveying path. The object 11 cut by the cutter 12 is conveyed by the downstream conveyor 131 to an apparatus disposed downstream of the cutter 12.

According to the study conducted by the inventors of the present invention, adhesion of foreign matter to the cut object 11 is caused by swarf that is generated when the plate-shaped object 11 is cut by the cutter 12 and adheres particularly to the surface of a component of the downstream conveyor 131 disposed close to the cutter 12.

The cutting apparatus 10 of the present embodiment may include a foreign-matter adhesion preventer 14 that is disposed between the cutter 12 and the downstream conveyor 131 and prevents foreign matter scattered by the cutter 12 from adhering to the downstream conveyor 131.

The foreign-matter adhesion preventer 14 may have any configuration as long as the foreign-matter adhesion preventer 14 can prevent adhesion of foreign matter such as swarf generated by the cutter 12 to the surface of the downstream conveyor 131. The foreign-matter adhesion preventer 14 may include, for example, at least one of an intangible foreign-matter adhesion preventer and a tangible foreign-matter adhesion preventer. The foreign-matter adhesion preventer 14 may be implemented by one of the intangible foreign-matter adhesion preventer and the tangible foreign-matter adhesion preventer. For example, the foreign-matter adhesion preventer 14 may be implemented by the intangible foreign-matter adhesion preventer. As another example, the foreign-matter adhesion preventer 14 may be implemented by the tangible foreign-matter adhesion preventer. Further, the foreign-matter adhesion preventer 14 may include both of the intangible foreign-matter adhesion preventer and the tangible foreign-matter adhesion preventer.

The intangible foreign-matter adhesion preventer uses an intangible object to suppress or prevent foreign matter such as swarf scattered by the cutter 12 from adhering to the downstream conveyor 131.

The intangible foreign-matter adhesion preventer is, for example, but is not limited to, an air curtain (air curtain device) that uses a gas as an intangible object and includes a gas supplier including gas discharge ports for discharging (or ejecting) the gas.

When the intangible foreign-matter adhesion preventer is, for example, an air curtain that uses a gas as an intangible object and includes a gas supplier including gas discharge ports for discharging (or ejecting) the gas, a gaseous barrier (air curtain flow) can be formed with the gas discharged from the gas discharge ports of the gas supplier included in the air curtain. The gaseous barrier can prevent swarf generated by the cutter 12 from being scattered downstream in the conveying direction of the object and adhering to the downstream conveyor 131. This in turn makes it possible to prevent the swarf adhering to the downstream conveyor 131 from being transferred and adhering to a lower surface 11*a* of the object 11 that contacts the downstream conveyor 131. Although the direction of the gas discharged from the gas discharge ports of the gas supplier included in the air curtain is not limited to any specific direction, the gas discharge ports may be configured to discharge the gas toward the lower surface 11*a* of the object 11, i.e., upward.

The tangible foreign-matter adhesion preventer uses a tangible object(s) to suppress or prevent foreign matter such as swarf scattered by the cutter 12 from adhering to the downstream conveyor 131. As the tangible object(s), the tangible foreign-matter adhesion preventer may include, for example, one or more of a plate-shaped or sheet-shaped barrier, a sponge, a scrubber, and a brush. Also, the tangible foreign-matter adhesion preventer may be implemented by one or more of a plate-shaped or sheet-shaped barrier, a sponge, a scrubber, and a brush. When the tangible foreign-matter adhesion preventer includes one or more of a plate-shaped or sheet-shaped barrier, a sponge, a scrubber, and a brush as the tangible object(s), the tangible object(s) is preferably formed along the Y-axis direction in FIG. 1.

When a component of the tangible foreign-matter adhesion preventer that functions as a barrier for preventing adhesion of foreign matter such as swarf generated by the cutter 12 to a surface of the downstream conveyor 131 is formed of a material such as a sponge or a scrubber that is unlikely to damage the downstream conveyor 131, the component may be disposed to contact the surface of the downstream conveyor 131 or the surface of a conveyor roller 131*a* of the downstream conveyor 131 described later. With this configuration where a component such as a sponge or a scrubber included in the tangible foreign-matter adhesion preventer is in contact with the surface of the downstream conveyor 131, even if foreign matter adheres to the surface of the downstream conveyor 131, it is possible to remove the foreign matter with the component of the tangible foreign-matter adhesion preventer.

Components of the cutting apparatus 10 of the present embodiment are described below.

The cutter 12 cuts the object 11 being conveyed into pieces with a desired size and shape and may have any appropriate configuration.

The shape of the cutting line of the cutter 12 is also not limited to any specific shape. For example, the cutter 12 can cut the object 11 along a cutting line that is orthogonal to the conveying direction of the object 11, i.e., a cutting line that is parallel to the Y axis in FIG. 1.

The configuration of the cutter 12 is not limited to that described above and may be selected according to the material of an object to be cut. The cutter 12 is preferably implemented by, for example, a rotary cutter or a rotary saw. A rotary cutter is particularly preferably used as the cutter 12.

As illustrated in FIG. 1, the rotary cutter may include a unit 12*a* including a rotational shaft 121 that is parallel to the Y axis and a blade 122 disposed on the surface of the rotational shaft 121, and a unit 12*b* having the same configuration as the unit 12*a*. The units 12*a* and 12*b* are rotated, respectively, in the directions indicated by arrows A and B in FIG. 1. When the blades 122 of the units 12*a* and 12*b* reach positions at which the blades 122 face each other, the object 11 is pinched between and cut by the blades 112.

However, because the units 12*a* and 12*b* of the rotary cutter are rotated in the conveying direction of the object 11 as indicated by arrows A and B, with the configuration of the related-art cutting apparatus, swarf tends to be scattered toward the downstream conveyor 131 and adhere to the downstream conveyor 131 and the lower surface 11*a* of the object 11.

On the other hand, with the cutting apparatus of the present embodiment, even if foreign matter such as swarf is generated by the cutter 12, adhesion of the foreign matter to the downstream conveyor 131 can be prevented, and therefore adhesion of the foreign matter to the lower surface 11*a* of the object 11 can also be prevented. Thus, the configuration of the present embodiment is particularly advantageous over the related-art configuration when a rotary cutter, which tends to generate foreign matter such as swarf, is used. For this reason, the cutter 12 is preferably implemented by a rotary cutter.

The configuration of the downstream conveyor 131 is not limited to any specific configuration as long as the downstream conveyor 131 can support and convey the plate-shaped object 11. For example, the downstream conveyor 131 is preferably implemented by one or more of a conveyor belt and a roller conveyor.

In the example of FIG. 1, the downstream conveyor 131 is implemented as a roller conveyor including conveyor rollers 131*a* through 131*d*. A part or the entirety of the roller conveyor may be replaced with a conveyor belt. Also, the length or the number of conveyor rollers of the downstream conveyor 131 may be freely determined to match the requirements.

Still, however, it is preferable that the downstream conveyor 131 includes at least the conveyor roller 131*a* disposed immediately after the cutter 12.

The cutting apparatus 10 preferably includes a conveyor-roller contrarotation controller 15*a* that controls the conveyor roller 131*a* of the downstream conveyor 131 disposed immediately after the cutter 12 to rotate in a direction that is opposite the conveying direction of the object 11.

With this configuration where the conveyor roller 131*a* is disposed immediately after the cutter 12 and rotated in a direction opposite the conveying direction of the object 11, i.e., the direction indicated by a dotted arrow "b" in FIG. 1, it is possible to remove foreign matter adhering to the surface of the conveyor roller 131*a* before the object 11 contacts the conveyor roller 131*a*. Thus, this configuration can more effectively prevent foreign matter from being transferred from the conveyor roller 131*a* to the lower surface 11*a* of the object 11.

During normal operation, the conveyor-roller contrarotation controller 15*a* may be configured to rotate the conveyor roller 131*a* in a direction that is the same as the conveying direction of the object 11, i.e., the direction indicated by a solid arrow "a" in FIG. 1, and to reverse the rotation at desired timing to rotate the conveyor roller 131*a* in the direction indicated by the dotted allow "b".

When adhesion of foreign matter to the conveyor roller 131*a* is sufficiently prevented by the foreign-matter adhesion preventer 14, the conveyor roller 131*a* may also be rotated in the direction that is the same as the conveying direction of the object 11.

Even when the conveyor roller 131*a* disposed immediately after the cutter 12 is rotated in the direction opposite the conveying direction of the object 11, conveyor components other than the conveyor roller 131*a* that constitute the downstream conveyor 131, e.g., the conveyor rollers 131*b* through 131*d*, can be rotated in the conveying direction of the object 11 as indicated by solid arrows in FIG. 1. The cutting apparatus 10 may also include a downstream-conveyor controller 15*b* for controlling the rotation of the conveyor rollers 131*b* through 131*d*.

The foreign-matter adhesion preventer 14 is disposed between the cutter 12 and the downstream conveyor 131.

As described above, in the related-art cutting apparatus, swarf generated by a cutter is scattered downstream in the conveying direction of an object, adheres to a downstream conveyor disposed downstream of the cutter, and the adhered swarf is transferred and adheres to the lower surface of the object. In the cutting apparatus 10 of the present embodiment, the foreign-matter adhesion preventer 14 is provided between the cutter 12 and the downstream conveyor 131 to prevent foreign matter such as swarf generated by the cutter 12 from being scattered over and adhering to the downstream conveyor 131. Thus, the cutting apparatus 10 of the present embodiment can prevent foreign matter such as swarf from adhering to the downstream conveyor 131 and to the lower surface 11*a* of the object 11 that contacts the downstream conveyor 131.

The foreign-matter adhesion preventer 14 may have any configuration as long as the foreign-matter adhesion preventer 14 can prevent adhesion of foreign matter such as swarf generated by the cutter 12 to the surface of the downstream conveyor 131. For example, the foreign-matter adhesion preventer 14 may include at least one of the intangible foreign-matter adhesion preventer and the tangible foreign-matter adhesion preventer.

The intangible foreign-matter adhesion preventer is, for example, an air curtain (air curtain device) that uses a gas as an intangible object and includes a gas supplier including gas discharge ports for discharging (or ejecting) the gas.

For example, when the intangible foreign-matter adhesion preventer is an air curtain that uses a gas as an intangible object and includes a gas supplier including gas discharge ports for discharging (or ejecting) the gas, a gaseous barrier (air curtain flow) can be formed with the gas discharged from the gas discharge ports of the gas supplier included in the air curtain.

Also, the tangible foreign-matter adhesion preventer may be implemented by, for example, one or more of a plate-shaped or sheet-shaped barrier, a sponge, a scrubber, and a brush.

Here, assuming that the foreign-matter adhesion preventer 14 is an intangible foreign-matter adhesion preventer that is an air curtain including a gas supplier 24, an exemplary configuration of the gas supplier 24 is described with reference to FIG. 2. The X axis, the Y axis, and the Z axis in FIG. 2 indicate directions that are the same as the directions indicated by the X axis, the Y axis, and the Z axis in FIG. 1.

Figure 2:
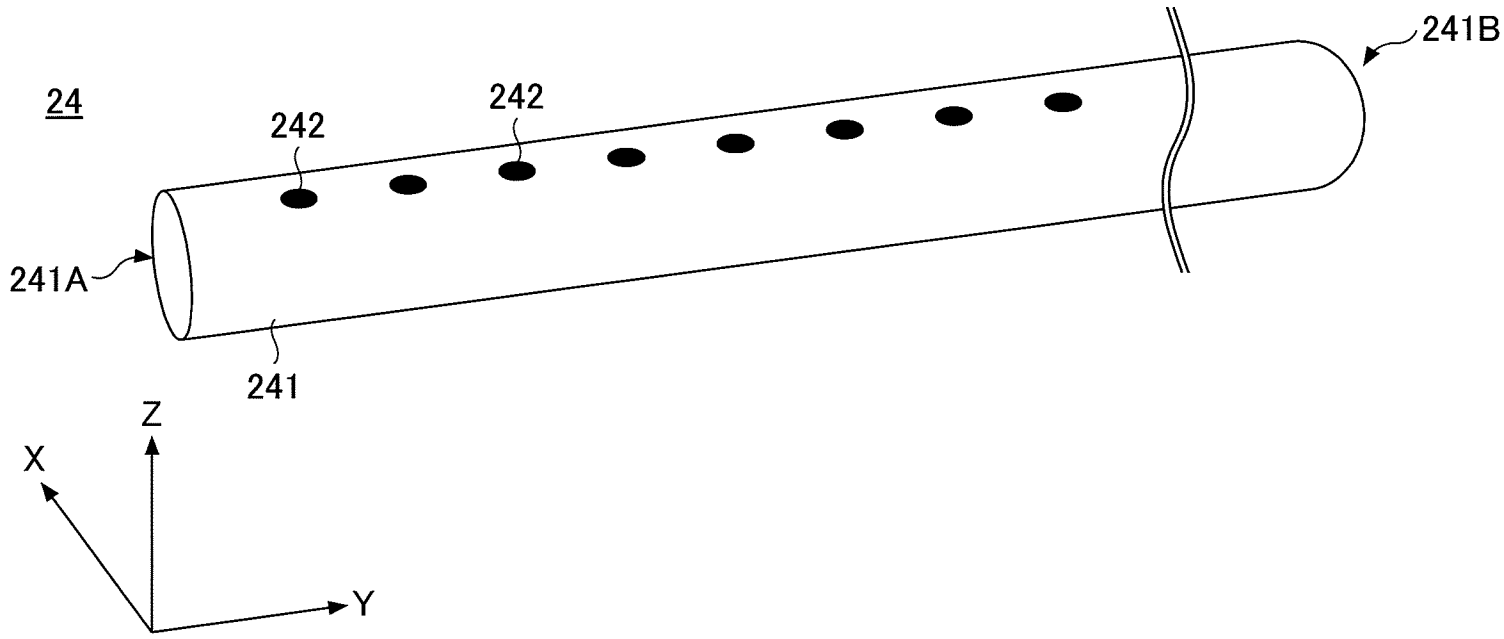
FIG. 2 is a drawing illustrating a gas supplier according to an embodiment of the present invention.

In the example of FIG. 2, the gas supplier 24 may include a hollow body 241. An end 241A of the body 241 may be closed, and another end 241B of the body 241 may be connected to a gas supply source (not shown). Alternatively, the end 241A may also be connected to a gas supply source. As illustrated in FIG. 2, gas discharge ports 242 may be formed in the body 241.

In the example of FIG. 2, the gas discharge ports 242 are implemented by multiple holes that are formed in the body 241 and arranged in a line in the longitudinal direction of the body 241, i.e., along the Y-axis direction in FIG. 2. However, the configuration of the gas discharge ports 242 is not limited to this example. For example, multiple holes may be arranged in two or more rows. Also, the gas discharge ports 242 may be implemented by one or more slits.

A gaseous barrier (air curtain flow) that can prevent swarf from being scattered downstream in the conveying direction of an object is preferably formed by discharging a gas from the gas discharge ports 242 of the gas supplier 24. For this purpose, in the state where the gas supplier 24 is installed in the cutting apparatus 10, the gas discharge ports 242 are preferably configured to discharge a gas toward the lower surface of an object being conveyed. Also, the gas discharge ports 242 are preferably arranged along the Y-axis direction, i.e., along the width direction of the object 11 and the cutter 12 when the gas supplier 24 is installed in the cutting apparatus 10.

The gas discharge ports 242 may have any appropriate size that is determined based on, for example, the pressure of a gas supplied from a gas supply source, the hardness of an object, the number of the gas discharge ports 242, and the shape of the gas discharge ports 242.

The direction of the gas discharged from the gas discharge ports 242 is not limited to any specific direction. For example, the gas is preferably discharged toward the lower surface 11*a* of the object 11 as described above and may be discharged vertically upward, i.e., in the Z-axis direction. When multiple gas discharge ports 242 are formed along the Y-axis direction and the gas is discharged in the Z-axis direction to form a gaseous barrier (air curtain flow), a gas flow along the YZ plane in FIG. 1 is formed.

The direction in which the gas is discharged is not limited to the Z-axis direction. For example, the gas may be discharged in an obliquely-upward direction that is inclined from the Z-axis direction toward the X-axis direction. Also, instead of being discharged only in one direction, the gas may be discharged in multiple directions.

The type of gas discharged from the gas supplier 24 may be determined freely based on the material of the object 11 manufactured and the environment where the cutting apparatus 10 is installed. However, air is preferably used due to its easy availability and high safety. Therefore, an air pump and/or a compressed-air cylinder is preferably used as the gas supply source connected to the gas supplier 24, and compressed air is preferably used as the gas supplied by the gas supply source.

The pressure of the gas such as compressed air supplied to the gas supplier 24 may be determined freely based on the material of an object and the shape and size of the gas discharge ports. For example, the pressure of the gas is preferably greater than or equal to 0.5 MPa and less than or equal to 5.0 MPa.

The gas may be continuously discharged from the gas supplier 24. However, to reduce the amount of gas used and to reduce damage to the object 11, it is preferable to intermittently discharge the gas in accordance with the operation of the cutter 12.

Accordingly, when the foreign-matter adhesion preventer 14 is an intangible foreign-matter adhesion preventer implemented by an air curtain that includes the gas supplier 24 including the gas discharge ports 242 for discharging a gas, the cutting apparatus 10 of the present embodiment preferably includes a gas discharge controller that controls the gas supplier 24 to intermittently discharge the gas from the gas discharge ports 242. That is, in FIG. 1, the gas discharge controller may be provided as a foreign-matter-adhesion-preventer controller 15*c* for controlling the foreign-matter adhesion preventer 14. The gas discharge controller is preferably configured to control the discharge of the gas in accordance with the operation of the cutter 12. Therefore, the cutting apparatus 10 may further include a cutter controller 15*d* for controlling the operation of the cutter 12. In this case, a signal line may be provided between the gas discharge controller and the cutter controller 15*d* to exchange information on the operation of the cutter 12. In this example, the cutter controller 15*d* is provided together with the gas discharge controller provided as the foreign-matter-adhesion-preventer controller 15*c*. However, even when the gas discharge controller is not provided, the cutter controller 15*d* may be provided only to control the operation of the cutter 12. When the foreign-matter adhesion preventer 14 is not the intangible foreign-matter adhesion preventer implemented by the air curtain including the gas supplier 24, e.g., when the foreign-matter adhesion preventer 14 is a tangible foreign-matter adhesion preventer, the foreign-matter-adhesion-preventer controller 15*c* may be configured to control the position of the foreign-matter adhesion preventer 14.

When the gas discharge controller is provided, for example, a valve may be provided between the gas supplier 24 and the gas supply source, and the gas discharge controller may be configured to open and close the valve to control the timing when the gas is discharged from the gas discharge ports 242 of the gas supplier 24. The gas may be discharged from the gas discharge ports 242 of the gas supplier 24 at any appropriate timing. For example, the gas is preferably discharged at a timing when swarf is generated by the cutter 12, i.e., during a period before and after the object 11 is cut by the cutter 12. The period during which the gas is discharged may be determined based on, for example, the amount of swarf scattered by the cutter 12 and/or the timing at which swarf is scattered.

As necessary, the cutting apparatus of the present embodiment may also include components other than those described above. For example, the cutting apparatus 10 may include an upstream conveyor 132 for conveying the object 11 to the cutter 12. In the example of FIG. 1, the upstream conveyor 132 is implemented as a roller conveyor including conveyor rollers 132*a* through 132*d*. However, the upstream conveyor 132 may be implemented by any type of conveyor that can support and convey the plate-shaped object 11. For example, the upstream conveyor 132 is preferably implemented by one or more of a conveyor belt and a roller conveyor. Also, the length or the number of conveyor rollers of the upstream conveyor 132 may be freely determined to match the requirements.

The cutting apparatus 10 may also include an upstream-conveyor controller 15*e* for controlling the operation of the upstream conveyor 132. The upstream-conveyor controller 15*e* may be configured to control the operation of the upstream conveyor 132 in synchronization with the operations of, for example, the cutter 12 and the downstream conveyor 131.

The cutting apparatus 10 may further include a length measuring device (not shown) that is disposed upstream of the cutter 12 in the conveying direction of the object and configured to measure the length of the object being conveyed by the upstream conveyor 132. The length measuring device may be either a contact type or a noncontact type as long as it can measure the length of an object. For example, the length measuring device may be configured to measure the length (or distance) of the object conveyed after the cutter 12 is driven and to report the measured length to the cutter controller 15*d*. The cutter controller 15*d* may be configured to drive the cutter 12 when the reported length reaches a predetermined cut length to cut the object at the predetermined cut length.

In the present embodiment, the conveyor-roller contrarotation controller 15*a*, the downstream-conveyor controller 15*b*, the foreign-matter-adhesion-preventer controller 15*c*, the cutter controller 15*d*, and the upstream-conveyor controller 15*e* are provided as separate controllers for controlling the respective components of the cutting apparatus 10. However, the present invention is not limited to this embodiment. For example, a cutting-apparatus controller 15 may be provided and configured to control the components of the cutting apparatus 10.

Further, the cutting apparatus 10 may include an upper air supplier (not shown) for removing foreign mater adhering to the upper surface of the object 11 being conveyed, and a scraper disposed to contact the surface of the rotating conveyor roller 131*a* to remove foreign matter adhering to the conveyor roller 131*a*.

The object 11 to be cut by the cutting apparatus 10 of the present embodiment may be any object having a plate shape. That is, the cutting apparatus 10 may be used to cut both of an end product and an intermediate product that is generated in the middle of manufacturing or processing.

However, the cutting apparatus 10 of the present embodiment is particularly useful when the object 11 is an intermediate product because an intermediate product is often cut into pieces with a desired size while being conveyed and foreign matter tends to adhere to its surface. Accordingly, the object 11 is preferably an intermediate product.

Examples of intermediate products used as the object 11 include one or more types of ceramic/resin molded articles such as green sheets that have not undergone at least one of drying and calcining.

Examples of end products made from one or more types of ceramic/resin molded articles, i.e., intermediate products, may include building materials such as gypsum building materials, electronic components, and structural materials. Examples of gypsum building materials include a gypsum board, a glass mat gypsum board, and a gypsum board including glass-fiber nonwoven fabric. Such end products may also be used as the object 11.

The thickness of the object 11 is not limited to any specific value, and may be determined based on, for example, the cutting ability of the cutter 12.

The cutting apparatus of the present embodiment described above includes a foreign-matter adhesion preventer that is disposed between a cutter and a downstream conveyor and configured to prevent foreign matter scattered from the cutter from adhering to the downstream conveyor. This configuration makes it possible to prevent foreign matter such as swarf generated by the cutter 12 from adhering to the downstream conveyor 131 and thereby makes it possible to prevent the foreign matter from adhering to the lower surface of the object 11 that contacts the downstream conveyor 131.

<Sheet-Material Manufacturing Apparatus and Gypsum-Building-Material Manufacturing Apparatus>

Next, exemplary configurations of a sheet-material manufacturing apparatus and a gypsum-building-material manufacturing apparatus according to the present embodiment are described.

The sheet-material manufacturing apparatus of the present embodiment may include the cutting apparatus described above.

The sheet-material manufacturing apparatus can manufacture a gypsum building material as a sheet material. In this case, the sheet-material manufacturing apparatus may be referred to as a gypsum-building-material manufacturing apparatus. Accordingly, the gypsum-building-material manufacturing apparatus of the present embodiment may also include the cutting apparatus described above.

Each of the sheet-material manufacturing apparatus and the gypsum-building-material manufacturing apparatus of the present embodiment may include, in addition to the cutting apparatus, various components for manufacturing a sheet material.

For example, when it is necessary to mix raw materials, each of the sheet-material manufacturing apparatus and the gypsum-building-material manufacturing apparatus of the present embodiment may include a mixer for mixing the raw materials. Also, each of the sheet-material manufacturing apparatus and the gypsum-building-material manufacturing apparatus of the present embodiment may include a molding apparatus that molds and processes a raw material, a raw-material mixture prepared by the mixer, or raw-material slurry to form a molded product with a desired shape and size.

Based on an assumption that a gypsum board is manufactured as a sheet material or a gypsum building material, a configuration of a gypsum-building-material manufacturing apparatus 30 is described below as an example of the configuration of the sheet-material manufacturing apparatus and the gypsum-building-material manufacturing apparatus of the present embodiment.

Figure 3:
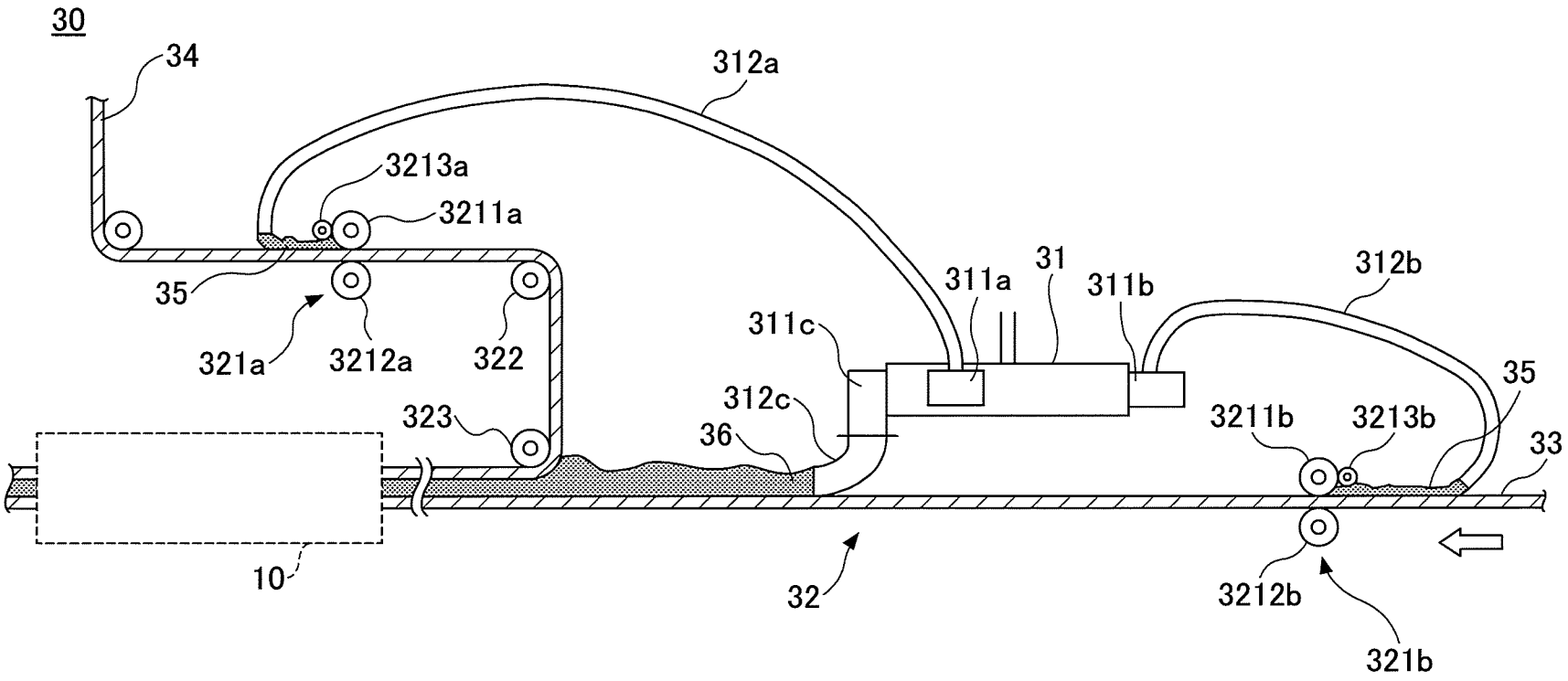
FIG. 3 is a drawing illustrating a sheet-material manufacturing apparatus according to an embodiment of the present invention.

As illustrated in FIG. 3, the gypsum-building-material manufacturing apparatus 30 includes a mixer 31 for mixing raw materials, a molding apparatus 32 for molding raw-material slurry (in the example of FIG. 3, gypsum slurry) prepared by the mixer 31, and the cutting apparatus 10. Details of the gypsum-building-material manufacturing apparatus 30 are described below.

First, the mixer 31 is described.

The mixer 31 may be disposed in a predetermined position relative to a conveying line such as front cover base paper described later, for example, above or alongside the conveying line. By one mixer 31, raw materials of the gypsum slurry including calcined gypsum, water, and optionally, additives are kneaded to prepare the gypsum slurry.

Calcined gypsum is also called calcium sulfate hemihydrate, and is an inorganic composition having a hydraulic property. Examples of calcined gypsum include β-calcined gypsum obtained by calcining one of or a mixture of natural gypsum, by-product gypsum, and flue-gas gypsum in the atmosphere; α-calcined gypsum obtained by calcining one of or a mixture of natural gypsum, by-product gypsum, and flue-gas gypsum in water (or vaper); and a mixture of the β-calcined gypsum and the α-calcined gypsum.

When manufacturing a gypsum building material such as a gypsum board, calcined gypsum used as a raw material preferably includes β-calcined gypsum, and the primary component of calcined gypsum used as a raw material of hardened gypsum is preferably β-calcined gypsum. Here, β-calcined gypsum can be referred to as the primary component of calcined gypsum used as a raw material of hardened gypsum when the mass percentage of β-calcined gypsum in the calcined gypsum is greater than 50%. The calcined gypsum used as a raw material of hardened gypsum of the present embodiment may be composed solely of β-calcined gypsum.

To manufacture α-calcined gypsum, it is necessary to pressure-sinter dihydrate gypsum such as natural gypsum in water or steam by using an autoclave. On the other hand, β-calcined gypsum can be manufactured by pressureless-sintering dihydrate gypsum such as natural gypsum in the atmosphere. Thus, compared with α-calcined gypsum, β-calcined gypsum can be manufactured more efficiently.

As additives, for example, one or more of the following may be used: an adhesion improver such as starch or polyvinyl alcohol for improving the adhesion between hardened gypsum and gypsum-board base paper (which is hereafter referred to as "front/back cover base paper"); inorganic fibers such as glass fibers; lightweight aggregate; a refractory such as vermiculite; a setting retarder; a setting accelerator; a water-reducing agent; a bubble-diameter adjuster such as sulfosuccinate surfactant; a water repellent such as silicone or paraffin; organic carboxylic acid; and organic carboxylate.

Here, calcined gypsum and some additives such as solid additives may be mixed and agitated beforehand, and the resulting gypsum composition may be supplied to the mixer 31.

Also, foam may be added at one or more of gypsum-slurry splitting ports 311*a*, 311*b*, and 311*c*, and gypsum slurry with a desired density may be obtained by adjusting the amount of foam added. For example, high-density gypsum slurry 35 may be prepared by not adding form or by adding a small amount of foam from the splitting ports 311*a* and 311*b*. Also, low-density gypsum slurry 36 may be prepared by adding, from the splitting port 311*c*, an amount of foam larger than the amount of foam added to the high-density gypsum slurry 35.

Thus, the mixer 31 of the gypsum-building-material manufacturing apparatus 30 can perform a gypsum slurry manufacturing process where calcined gypsum, water, additives, and foam are mixed and kneaded to prepare gypsum slurry. Additives and foam are optional components and may not be added in the gypsum slurry manufacturing process.

Delivery pipes 312*a* and 312*b* and a pipe line 312*c* for supplying prepared gypsum slurry to the molding apparatus 32 may be connected to the splitting ports 311*a*, 311*b*, and 311*c*.

In the example of FIG. 3, low-density gypsum slurry and high-density gypsum slurry are manufactured by one mixer 31. However, two mixers may be provided, and low-density gypsum slurry and high-density gypsum slurry may be produced by the corresponding mixers.

Next, an exemplary configuration of the molding apparatus 32 is described.

The molding apparatus may include roll coaters 321*a* and 321*b* for spreading gypsum slurry over front cover base paper 33 and back cover base paper 34, and a molder 323.

In FIG. 3, the front cover base paper 33, which is a surface material, is conveyed along a production line from right to left.

The high-density gypsum slurry 35 obtained by the mixer 31 is supplied via the delivery pipes 312*a* and 312*b* onto the front cover base paper 33 and the back cover base paper 34 at positions upstream of the roll coaters 321*a* and 321*b* in their conveying directions.

The high-density gypsum slurry 35 supplied onto each of the front cover base paper 33 and the back cover base paper 34 reaches a spreader implemented by the corresponding one of the roll coaters 321*a* and 321*b*, and is spread by the spreader. The roll coaters 321*a* and 321*b* include application rolls 3211*a* and 3211*b*, backing rolls 3212*a* and 3212*b*, and residue removing rolls 3213*a* and 3213*b*, respectively. When the front cover base paper 33 and the back cover base paper 34 pass between the application rolls 3211*a* and 3211*b* and the backing rolls 3212*a* and 3212*b*, respectively, the gypsum slurry 35 is spread over the front cover base paper 33 and the back cover base paper 34.

As a result, both of a thin layer of the gypsum slurry 35 and a margin area are formed on the front cover base paper 33. Similarly, a thin layer of the gypsum slurry 35 is formed on the back cover base paper 34. In the example of FIG. 3, the gypsum slurry 35 is applied to the front cover base paper 33 and the back cover base paper 34 by using the roll coaters 321*a* and 321*b*. However, the present invention is not limited to this example. For example, the gypsum slurry 35 may be applied to only one of the front cover base paper 33 and the back cover base paper 34 by using the roll coater 321*a* or 321*b*. Also, the gypsum slurry 35 may be applied only to the side edges of the front cover base paper 33.

The front cover base paper 33 is conveyed in the same conveying direction. On the other hand, the conveying direction of the back cover base paper 34 is changed by a turning roller 322 toward the conveying line of the front cover base paper 33. Then, both of the front cover base paper 33 and the back cover base paper 34 reach the molder 323. Low-density gypsum slurry 36 is supplied from the mixer 31 via the pipe line 312*c* to a space between the thin layers of the gypsum slurry 35 formed on the front cover base paper 33 and the back cover base paper 34. As a result, a continuous layered structure, which includes a layer formed of the high-density gypsum slurry 35, a layer formed of the low-density gypsum slurry 36, and a layer formed of the high-density gypsum slurry 35, is formed between the front cover base paper 33 and the back cover base paper 34.

Also, instead of using high-density gypsum slurry and low-density gypsum slurry, one type of gypsum slurry with a given density may be produced and supplied onto the front cover base paper 33 and the back cover base paper 34.

In this case, one type of gypsum slurry with a predetermined density is supplied onto front cover base paper, which is being continuously conveyed, to form a layer of the gypsum slurry. The front cover base paper is folded along score lines formed near the side edges of the front cover base paper such that the gypsum slurry is wrapped by the front cover base paper. Next, back cover base paper, which is being conveyed at the same speed as the front cover base paper, is placed on the layer of the gypsum slurry. Then, the resulting structure is caused to pass through a molder that determines the thickness and the width of a gypsum board. Thus, a gypsum board can be formed through the above process. In this case, a type of gypsum slurry layer is formed between the front cover base paper and the back cover base paper.

Thus, the molding apparatus 32 of the gypsum-building-material manufacturing apparatus 30 can perform a molding process for molding gypsum slurry.

Also, the cutting apparatus 10 may be disposed downstream of the molding apparatus 32. The cutting apparatus 10 can cut a molded product formed by the molding apparatus into pieces with a desired size.

In calcined gypsum (hemihydrate gypsum), needle crystals of dihydrate gypsum are generated, condensed, coagulated, and hardened due to hydration reaction. Accordingly, the distance (conveying distance) between the molding apparatus 32 and the cutting apparatus 10 is preferably determined such that after a molded product is produced by the molding apparatus 32 and before the molded product is cut by the cutting apparatus 10, the hydration reaction of calcined gypsum proceeds and the hardness of the molded product becomes suitable to be cut by the cutting apparatus 10.

Thus, a hardening process where a molded product obtained by the molding process is hardened can be performed at a position between the molding apparatus 32 and the cutting apparatus 10 of the gypsum-building-material manufacturing apparatus 30 illustrated in FIG. 3; and the cutting apparatus 10 can perform a cutting process for cutting the hardened product into pieces with a desired size.

Descriptions of the configuration of the cutting apparatus 10 are provided above and are therefore omitted here.

In the above embodiment, it is assumed that a gypsum board is manufactured as an example of a sheet material or a gypsum building material. However, the present invention is not limited to this embodiment. For example, various gypsum building materials such as a glass-mat gypsum board and a glass-fiber nonwoven-fabric gypsum board can be manufactured by replacing gypsum board base paper used as a surface material with a glass mat or a glass fiber nonwoven fabric (glass tissue), and placing it on the surface of gypsum slurry or embedding it near the surface of gypsum slurry.

The above embodiment may also be applied to manufacture sheet materials other than gypsum building materials. For example, the above embodiment may be applied to manufacture electronic component materials, other ceramic products such as structural materials, and resin products.

When other ceramic products (e.g., slag gypsum boards and cement boards) or resin products are to be manufactured as sheet materials instead of gypsum building materials, the configurations of a mixer and a molding apparatus are not limited to those described above and may be changed to suit the types of raw materials and products to be manufactured.

Also, as necessary, each of the sheet-material manufacturing apparatus and the gypsum-building-material manufacturing apparatus of the present embodiment may also include other apparatuses and units other than the mixer, the molding apparatus, and the cutting apparatus described above.

For example, each of the sheet-material manufacturing apparatus and the gypsum-building-material manufacturing apparatus may include a dryer for drying a molded product, a calcining unit for calcining a molded product, and a (second) cutting apparatus for further cutting an object cut by the (first) cutting apparatus 10 to match a product size.

Each of the sheet-material manufacturing apparatus and the gypsum-building-material manufacturing apparatus of the present embodiment includes the cutting apparatus including the foreign-matter adhesion preventer disposed between the cutter and the downstream conveyor. This configuration makes it possible to prevent foreign matter such as swarf generated by the cutter 12 from adhering to the downstream conveyor 131 and thereby makes it possible to prevent the foreign matter from adhering to the lower surface of the object 11 that contacts the downstream conveyor 131.

A cutting apparatus, an apparatus for manufacturing a sheet material, and an apparatus for manufacturing a gypsum building material according to embodiments of the present invention are described above. However, the present invention is not limited to the specifically disclosed embodiments, and variations and modifications may be made without departing from the scope of the present invention.

The present application claims priority to Japanese Patent Application No. 2016-179922 filed on Sep. 14, 2016, the entire contents of which are hereby incorporated herein by reference.

EXPLANATION OF REFERENCE NUMERALS

11 Object
12 Cutter
131 Downstream conveyor
131*a* Conveyor roller
14 Foreign-matter adhesion preventer
24 Gas supplier
242 Gas discharge ports
15*a* Conveyor-roller contrarotation controller

The invention claimed is:

1. A cutting apparatus, comprising:

a rotary cutter disposed in a conveying path for conveying a plate-shaped object and configured to cut the object;

a downstream conveyor disposed downstream of the rotary cutter in the conveying path and configured to convey the object, the downstream conveyor including at least one roller-conveyor roller disposed between the rotary cutter and other roller-conveyor rollers disposed downstream of the one roller-conveyor roller, wherein said at least one roller-conveyor roller and the other roller-conveyor rollers are all disposed on a lower side of the downstream conveyor;

at least one foreign-matter adhesion preventer disposed between the rotary cutter and the downstream conveyor and configured to prevent foreign matter scattered by the rotary cutter from adhering to the downstream conveyor; and a conveyor-roller contrarotation controller configured to control the one roller-conveyor roller of the downstream conveyor to rotate in a direction that is opposite to a direction of rotation of the other roller-conveyor rollers that defines a conveying direction in which the object is conveyed.

2. The cutting apparatus as claimed in claim 1, wherein the foreign-matter adhesion preventer is an intangible foreign-matter adhesion preventer that uses an intangible object to prevent the foreign matter scattered by the rotary cutter from adhering to the downstream conveyor.

3. The cutting apparatus as claimed in claim 2, wherein the intangible foreign-matter adhesion preventer is an air curtain that uses a gas as the intangible object, the air curtain including a gas supplier that includes gas discharge ports for discharging the gas.

4. The cutting apparatus as claimed in claim 3, wherein the gas discharge ports are configured to discharge the gas toward a lower surface of the object.

5. The cutting apparatus as claimed in claim 3, further comprising:

a gas discharge controller configured to control the gas supplier to intermittently discharge the gas from the gas discharge ports.

6. The cutting apparatus as claimed in claim 1, wherein the foreign-matter adhesion preventer is a tangible foreign-matter adhesion preventer that uses a tangible object to prevent the foreign matter scattered by the rotary cutter from adhering to the downstream conveyor.

7. The cutting apparatus as claimed in claim 6, wherein the tangible foreign-matter adhesion preventer includes one or more of a plate-shaped or sheet-shaped barrier, a sponge, a scrubber, and a brush.

8. The cutting apparatus as claimed in claim 1, wherein the object is an intermediate product.

9. A manufacturing apparatus for manufacturing a sheet material, the manufacturing apparatus comprising:

the cutting apparatus of claim 1.

10. A manufacturing apparatus for manufacturing a gypsum building material, the manufacturing apparatus comprising:

the cutting apparatus of claim 1.

* * * * *